US008391752B2

(12) United States Patent
Sato

(10) Patent No.: US 8,391,752 B2
(45) Date of Patent: Mar. 5, 2013

(54) DEVELOPER UNIT FOR AN IMAGE FORMING APPARATUS

(75) Inventor: Shougo Sato, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 92 days.

(21) Appl. No.: 12/917,474

(22) Filed: Nov. 1, 2010

(65) Prior Publication Data

US 2011/0103844 A1 May 5, 2011

(30) Foreign Application Priority Data

Oct. 30, 2009 (JP) ..... 2009-250500

(51) Int. Cl.
*G03G 15/08* (2006.01)

(52) U.S. Cl. ..... 399/258

(58) Field of Classification Search ..... 399/119, 399/120, 252, 255, 256, 258, 262, 263
See application file for complete search history.

(56) References Cited

U.S. PATENT DOCUMENTS

| | | | | |
|---|---|---|---|---|
| 5,734,952 | A | 3/1998 | Murakami et al. | |
| 5,867,756 | A | 2/1999 | Suzuki et al. | |
| 8,208,838 | B2 * | 6/2012 | Kakuta et al. | 399/262 |
| 2008/0292331 | A1 * | 11/2008 | Yokomori et al. | 399/27 |
| 2008/0298837 | A1 | 12/2008 | Mase | |
| 2009/0169245 | A1 * | 7/2009 | Sato | 399/111 |
| 2009/0226205 | A1 | 9/2009 | Sato et al. | |
| 2010/0202803 | A1 | 8/2010 | Sato | |

FOREIGN PATENT DOCUMENTS

| | | | |
|---|---|---|---|
| CN | 101833272 | A | 8/2010 |
| CN | 101833272 | A | 9/2010 |
| EP | 2244136 | A2 | 10/2010 |
| EP | 2317398 | A1 | 5/2011 |
| JP | H09-319202 | A | 12/1997 |
| JP | 3090041 | B2 | 9/2000 |
| JP | 2009-047770 | A | 3/2009 |

OTHER PUBLICATIONS

Machine translation of Mitsuru (JP 09319202 A). Publication date: Dec. 12, 1997.*

State Intellectual Property Office of the People'S Republic of China, The First Office Action for Chinese Patent Application No. 201010538336.5 (counterpart to above-captioned patent application), mailed Apr. 12, 2012.

European Patent Office, extended European Search Report for European Patent Application No. 10013900.5 (counterpart European patent application), dated Sep. 25, 2012.

State Intellectual Property Office of the People'S Republic of China, The Second Office Action for Chinese Patent Application No. 201010538336.5 (counterpart Chinese patent application), mailed Nov. 1, 2012.

* cited by examiner

*Primary Examiner* — Walter L Lindsay, Jr.
*Assistant Examiner* — Frederick Wenderoth
(74) *Attorney, Agent, or Firm* — Baker Botts L.L.P.

(57) ABSTRACT

A developer unit for an image forming apparatus is provided. The developer unit includes a developer device with a developer agent carrier and a developer agent supplier, and a developer agent container, which contains the developer agent and is arranged in a lower position with respect to the developer device. The developer agent container is formed to have a fitting wall, which is curved inward at a position to be adjacent to the developer device. The fitting wall is formed to have a feeding opening and a collecting opening. The developer unit is further provided with a first conveyer, which is rotated about a rotation axis to sweep an inner surface of the developer agent container and convey the developer agent toward the feeding opening, and a second conveyer, which is arranged along the developer agent supplier and conveys the developer agent toward the collecting opening.

6 Claims, 8 Drawing Sheets

DEVELOPER UNIT FOR AN IMAGE FORMING APPARATUS

CROSS REFERENCE TO RELATED APPLICATION

This application claims priority from Japanese Patent Application No. 2009-250500, filed on Oct. 30, 2009, the entire subject matter of which is incorporated herein by reference.

BACKGROUND

1. Technical Field

An aspect of the present invention relates to a developer unit for an image forming apparatus.

2. Related Art

An image forming apparatus for forming an image in a developer agent on a recording medium having a developer unit has been known. The developer unit is often provided with a developer device with a supplier roller to supply the developer agent to a developer roller and a developer roller to carry the developer agent on a surface thereof. Further, the developer unit is often provided with a developer agent container to contain the developer agent to be supplied to the developer device. In the developer unit, the developer agent container may be arranged in a lower position with respect to the developer device.

The developer agent supplied to the developer device is electrically charged so that a part of the electrically charged developer agent adheres to the developer roller to be carried. The remaining of the electrically charged developer agent, which is not carried by the developer roller, may be retrieved in the developer agent container so that the developer agent is again supplied to the developer device to be used. Thus, the developer agent is circulated between the developer agent container and the developer device. As the developer agent is circulated, the developer agent, deteriorated by the repetitive electrical charges, and some developer agent in a different contaminating color can be evenly distributed in an unused fresh developer agent within the developer agent container in order to maintain consistent image-forming quality.

SUMMARY

In such the developer unit, in which the developer agent is circulated, however, if the developer agent container is arranged in the lower position with respect to the developer device, supplying the developer agent from the developer agent container to the developer device against gravity may be difficult. Specifically, supplying the developer agent evenly to an entire lengthwise-range of the supplier roller against gravity is difficult. When the developer agent is not supplied to the supplier roller properly, the developer device may not be supplied with a substantial amount to maintain the desired image-forming quality, and image-forming errors may be caused.

In view of the above deficiencies, the present invention is advantageous in that a developer unit, in which a developer agent is circulated smoothly and the developer agent is supplied to the developer roller efficiently, is provided.

According to an aspect of the present invention, a developer unit for an image forming apparatus to form an image on a recording sheet is provided. The developer unit includes a developer device having a developer agent carrier, which carries a developer agent on a surface thereof, and a developer agent supplier, which supplies the developer agent to the developer agent carrier, and a developer agent container, which contains the developer agent to be supplied to the developer device and is arranged in a lower position with respect to the developer device. The developer agent container is formed to have a fitting wall, which is curved inward at a position to be adjacent to the developer device. The fitting wall is formed to have a feeding opening, through which the developer agent in the developer agent container is supplied to the developer device, and a collecting opening, through which the developer agent in the developer device is retrieved. The developer unit is further provided with a first conveyer, which is rotated about a rotation axis to sweep an inner surface of the developer agent container and convey the developer agent toward the feeding opening and a second conveyer, which is arranged along the developer agent supplier and conveys the developer agent toward the collecting opening.

BRIEF DESCRIPTION OF THE ACCOMPANYING DRAWINGS

DETAILED DESCRIPTION

Hereinafter, an embodiment of the present invention will be described with reference to the accompanying drawings. A color multifunction peripheral device (hereinafter, MFP) 1 represents an image processing device having a developer unit 61 according to the present invention.

Overall Configuration of the MFP

Figure 1:
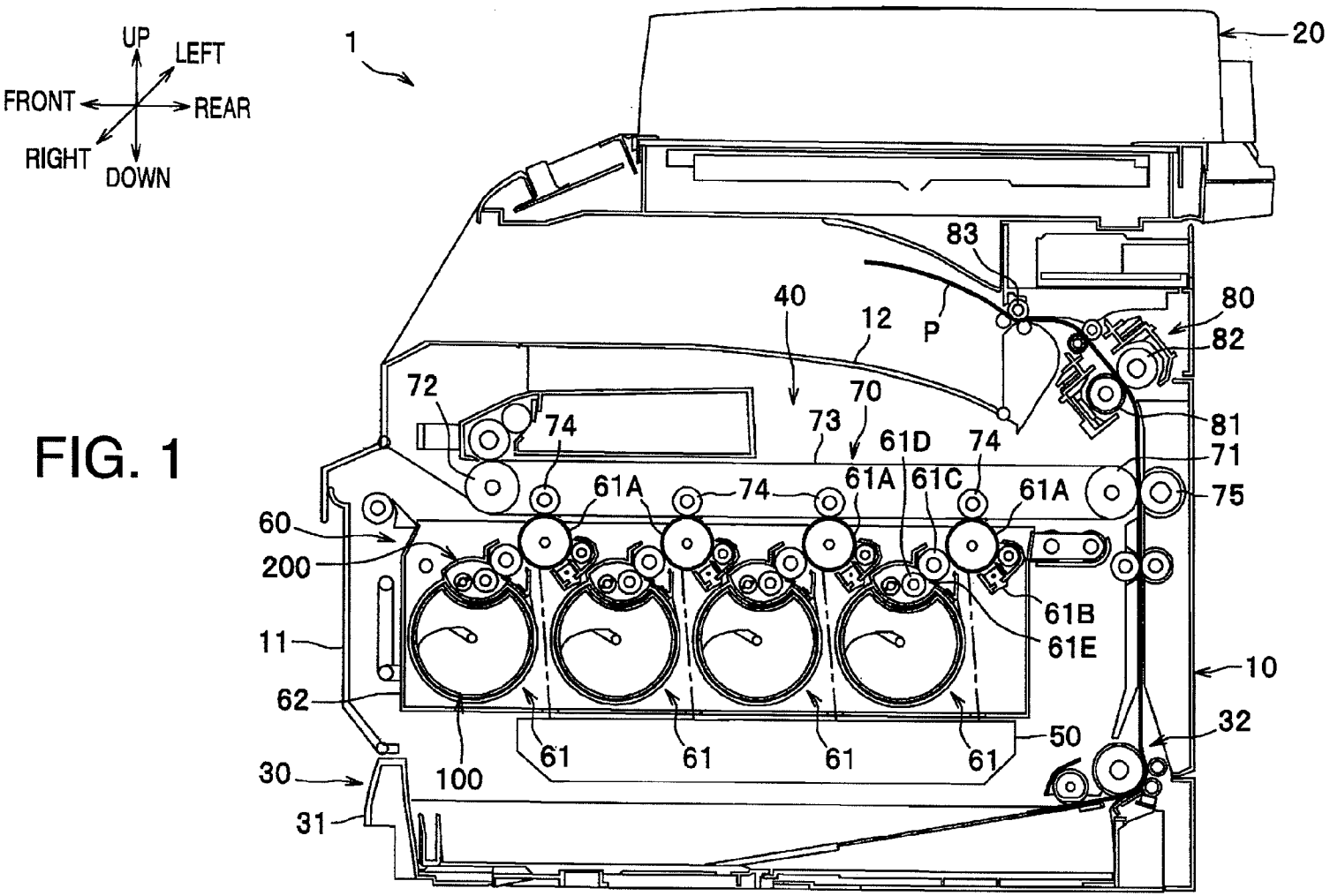
FIG. 1 is a schematic cross-sectional view of a multifunction peripheral device (MFP) having developer units according to an embodiment of the present invention.

As shown in FIG. 1, the MFP 1 is equipped with a chassis 10 and a flatbed scanner 20. In the chassis 10, the MFP 1 is provided with a sheet-feed unit 30, which feeds recording sheet P in a feeding path, and an image forming unit 40, which forms an image on the sheet P being fed.

Figure 2:
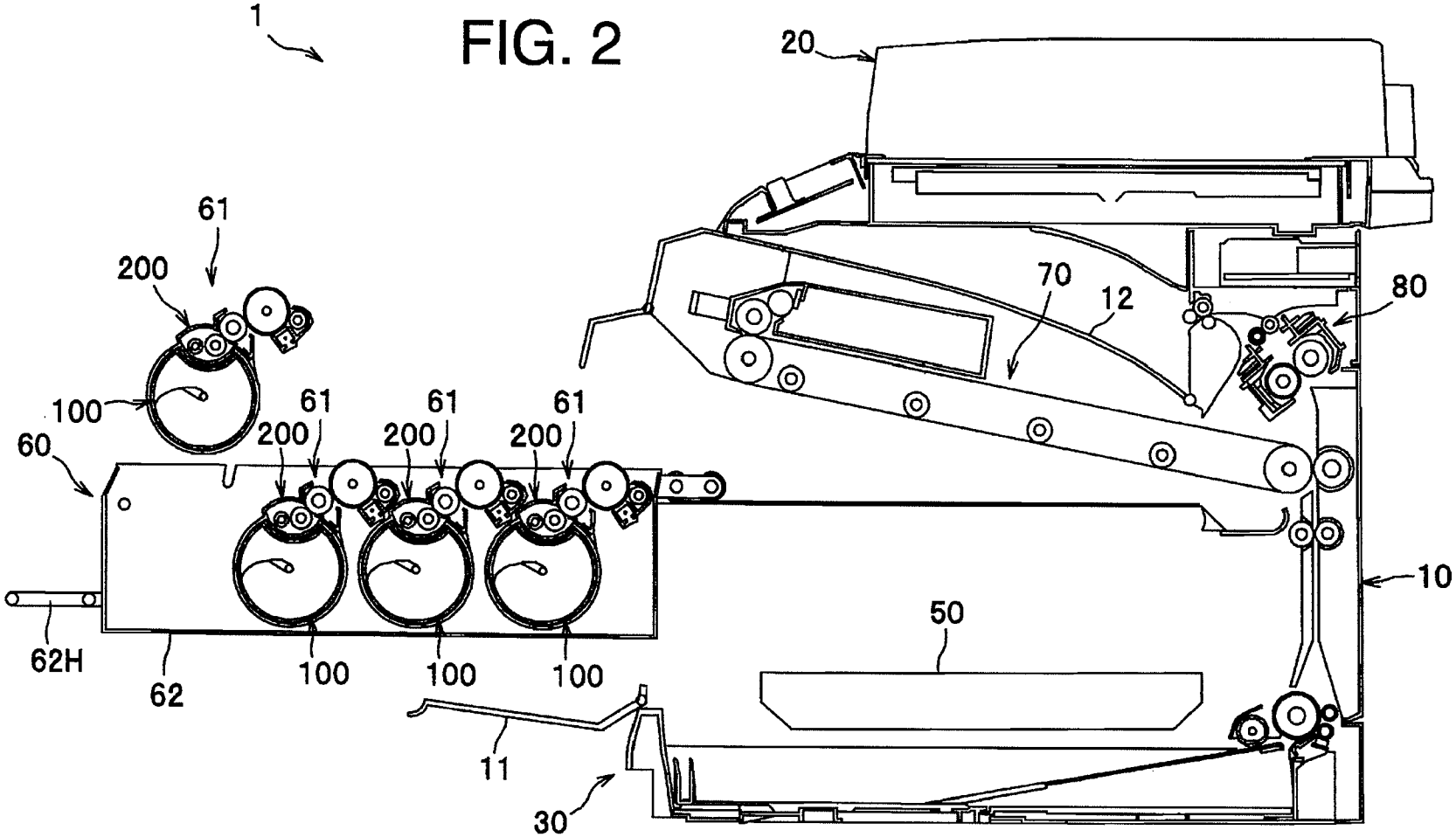
FIG. 2 is a schematic view of the MFP and the developer units according to the embodiment of the present invention with a holder case removed out of a chassis.
Figure 3:
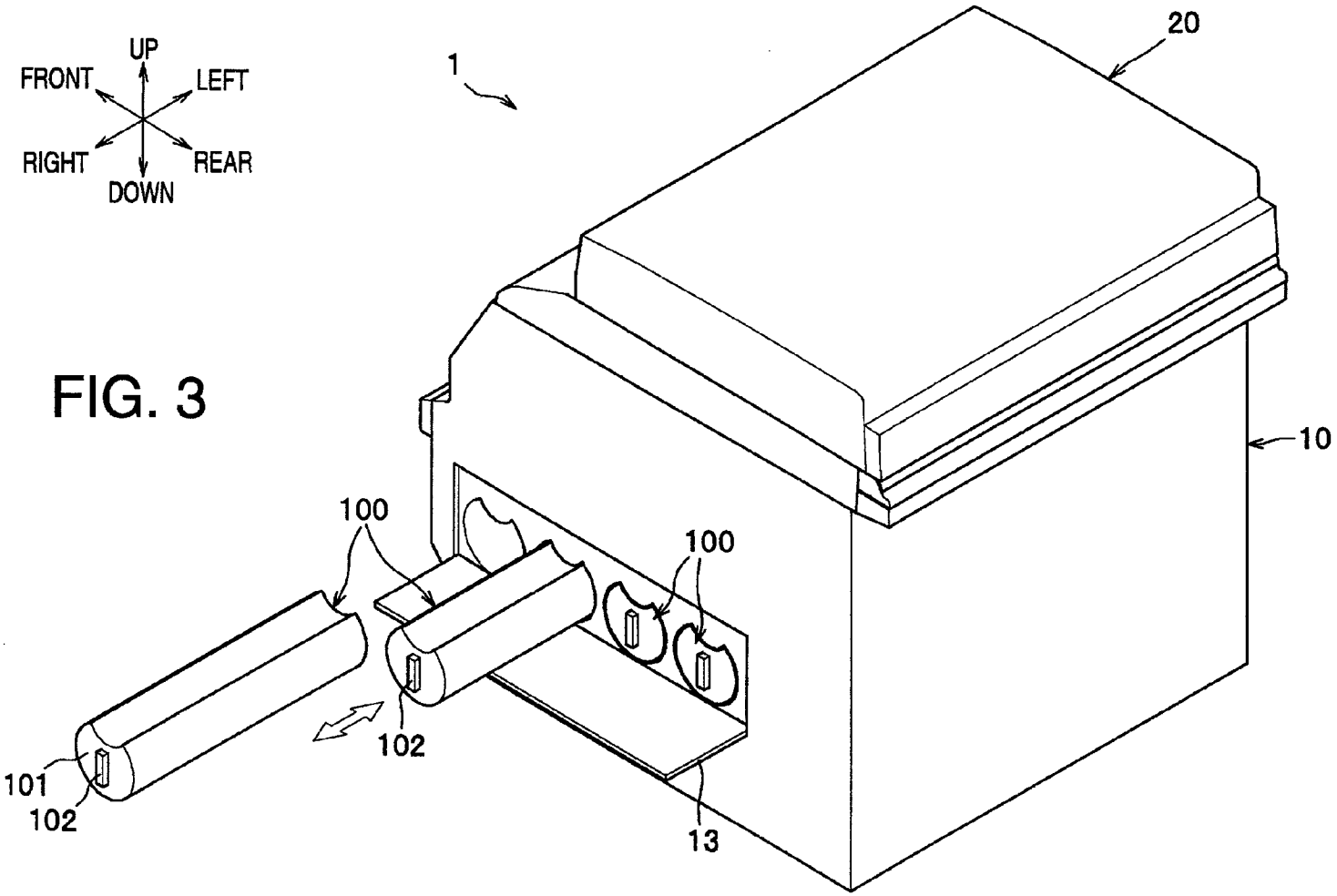
FIG. 3 is a perspective view of the MFP and toner boxes drawn out of the developer units according to the embodiment of the present invention.

In the present embodiment, directions concerning the MFP 1 will be referred to in accordance with orientation of the MFP 1 shown in FIG. 1. That is, a viewer's right-hand side appearing in FIG. 1 is referred to as a rear side of the MFP, and a left-hand side, which is opposite side from the rear side, is referred to as front. Further, a viewer's nearer side is referred to as right, and a further side is referred to as left. Furthermore, vertical (up-down) direction of the MFP 1 corresponds to an up-down direction appearing in FIG. 1. Directions of the drawings in FIG. 2 are similarly based on the orientation of the MFP 1 as defined above and correspond to those with respect to the MFP 1 shown in FIG. 1. In FIGS. 3-6 and 8 directions of the drawings are as indicated by arrows.

The flat bed scanner 20 is a known document reader, which is arranged on top of the chassis 10. The flatbed scanner 20 irradiates light onto a source document to read an image formed thereon and creates image data representing the read image. Thus, the image on the source document can be copied.

The sheet-feed unit 30 is arranged in a lower section of the chassis 10. The sheet-feed unit 30 includes a sheet-feed tray 31, in which the sheets P are stored, and a sheet-feeder 32, which conveys the sheets P one-by-one from the sheet-feed tray 31 to the image forming unit 40.

The image forming unit 40 includes an exposure section 50, a processing section 60, a transfer section 70, and a fixing section 80.

The exposure section 50 is arranged in an upper position with respect to the sheet-feed unit 30 and includes a laser-beam source, a polygon mirror, a lens, and a reflection mirror, which are not shown. A laser beam emitted from the laser-beam source is reflected on the polygon mirror and the reflection mirror and transmits through the lens to be casted to scan on surfaces of photosensitive drums 61A.

The processing section 60 is arranged above the exposure section 50 and includes four developer units 61, which are aligned in line along a front-rear direction, and a holder case 62 to hold the developer units 61.

Each of the developer units 61 includes a toner box 100 and a developer device 200. The toner box contains toner being a developer agent therein. Each toner in the toner box 100 is in a different color, and in the present embodiment, a colored image is formed in the four colored toners. The developer device 200 includes a photosensitive drum 61A, a charger 61B, a developer roller 61C to carry the toner, a supplier roller 61D, and a spreader blade 61E (see FIG. 4). The developer unit 61 including the toner box 100 and the developer device 200 will be described later in detail.

The holder case 62 can be installed in the chassis 10 through an opening, which can be covered with a front cover 11. The holder case 62 has a handle 6211, and when the front cover 11 is open (see FIG. 2), the holder case 62 can be drawn out of the chassis 10 by the handle 62H. When the holder case 62 is outside the chassis 10, the developer units 61 can be removed from the chassis 10 and replaced with new developer units 61.

The transfer section 70 is arranged above the processing section 60. The transfer section 70 includes a driving roller 71, a driven roller 72, and an endless intermediate transfer belt 73, which is extended to roll around the driving roller 71 and the driven roller 72, four primary transfer rollers 74, and a secondary transfer roller 75. The intermediate transfer belt 73 is arranged to have its upper and outer surface to be in contact with the photosensitive drums 61A. The primary transfer rollers 74 are arranged in positions to be in contact with an upper-inner surface of the intermediate transfer belt 73 to nip the intermediate transfer belt 73 with the photosensitive drums 61A. The secondary transfer roller 75 is arranged in a position opposite from the driving roller 71 across the intermediate transfer belt 73 and nips the intermediate transfer belt 73 with the driving roller 71.

The fixing section 80 is arranged in an upper-rear position with respect to the transfer section 70 and includes a heat roller 81 and a pressure roller 82. The pressure roller 82 is arranged in a position opposite from the heat roller 81 and presses the sheet P against the heat roller 81.

In the image forming unit 40, the charger 61B charges the surface of the photosensitive drum 61A evenly, and the surface of the photosensitive drum 61A is exposed to the laser beam emitted based on the image data from the exposure section 50 in order to form an electrostatic latent image thereon. Meanwhile, the toner in the toner box 100 is supplied to the developer roller 61C via the supplier roller 61D and spread evenly in a layer of a predetermined thickness by the spreader blade 61E to be carried by the developer roller 61C.

When the toner on the developer roller 61C comes in contact with the photosensitive drum 61A, the toner is supplied to the surface of regions corresponding to the electrostatic latent image formed on the photosensitive drum 61A. Accordingly, the electrostatic latent image is developed to be a toner image on the photosensitive drum 61A. The toner image on the photosensitive drum 61A is transferred onto the upper-outer surface of the intermediate transfer belt 73 at the position between the photosensitive drum 61A and the primary transfer roller 74. When the developer unit 60 has four developer devices 200, four toner images in four colors are successively overlaid on the upper-outer surface of the intermediate transfer belt 73. Meanwhile, the sheet P is picked up from the sheet-feed unit 30 and conveyed upward to pass through between the intermediate transfer belt 73 and the secondary transfer roller 75. Accordingly, the overlaid toner images in four colors are transferred onto the surface of the sheet P. The sheet P with the colored image is further conveyed in the fixing section 80 between the heat roller 81 and the pressure roller 82, and the colored image is thermally fixed on the sheet P. The sheet P with the thermally-fixed image is further conveyed by a discharge roller 83 to be ejected out of the chassis 10. The ejected sheet P is laid in a discharge tray 12, which is formed in an upper section of the chassis 10.

Configuration of the Developer Unit

The developer unit 61 including the toner box 100 and the developer device 200 will be described in detail hereinbelow.

Firstly, the toner box 100 will be described. The toner box 100 is formed to have a shape of a partially-dented cylinder with left and right side walls 101 (see FIG. 3). The toner box 100 is installed in the developer unit 61 to be detachably attached to the developer device 200. In particular, the toner box 100 can be detached from the developer device 200 when drawn rightward and can be attached to the developer device 200 when slid leftward through an opening, which is exposed when a side cover 13 of the chassis 10 is open.

The toner box 100 is formed to have a knob 102, which can be gripped by a user to pull the toner box 100, on an outer surface of the right side wall 101. The toner box 100 can be attachable to and detachable from the developer device 200 when the developer device 200 is outside the holder case 62 and outside the chassis 10 (see FIG. 2).

Figure 4:
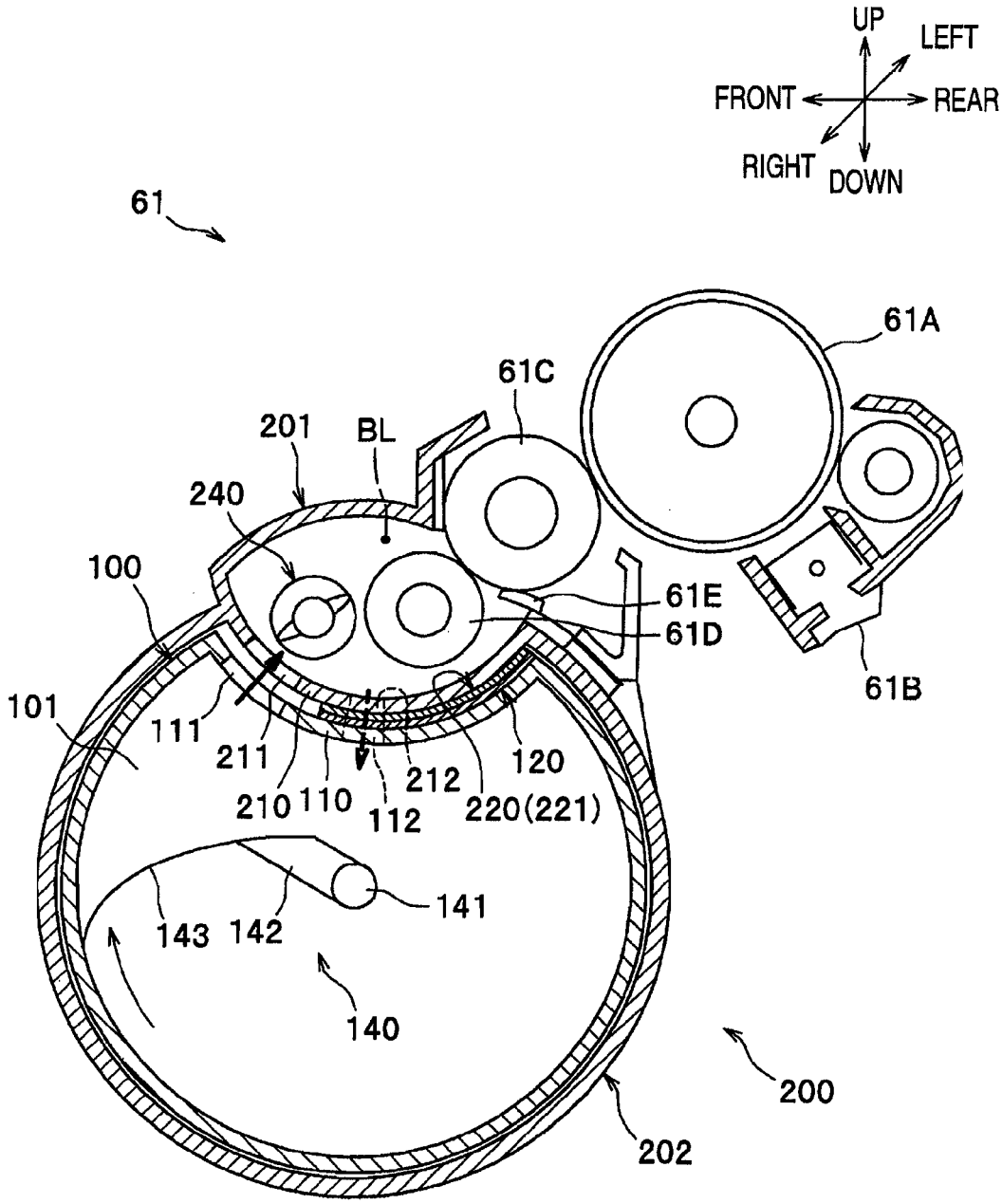
FIG. 4 is a cross-sectional side view of the developer unit according to the embodiment of the present invention with shutters in open positions.

When the toner box 100 is installed in the developer unit 61, the toner box 100 is in a lower and adjoining position with respect to a developer section 201 of the developer device 200 (see FIG. 4). The developer section 201 includes the developer roller 61C and the supplier roller 61D.

In the toner box 100, a circumferential surface of the cylinder is formed to have a fitting wall 110 in a position to be adjacent to the developer device 200 when the toner box 100 is attached to the developer device 200. The fitting wall 110 is curved inward in an arc to fit with an inner curved surface of the adjoining developer device 200. The fitting wall 110 is dented, in a cross-sectional view (see FIG. 4), to center around a reference line BL, which extends in parallel with a rotation axis 141 of an agitator 140 in the toner box 100. Description of the agitator 140 will be given later in detail.

The fitting wall 110 is formed to have a first feeding hole 111 and two first collecting holes 112. The first feeding hole 111 is an opening, through which the toner stored in the toner box 100 is supplied to the developer device 200. A flow of supplying the toner through the first feeding hole 111 is indicated by a thick solid arrow in FIG. 4. The first collecting holes 112 are openings, through which the toner in the developer device 200 is retrieved to be stored in the toner box 100. A flow of collecting the toner through the first collecting holes 112 is indicated by a thick broken arrow in FIG. 4.

Figure 5A:
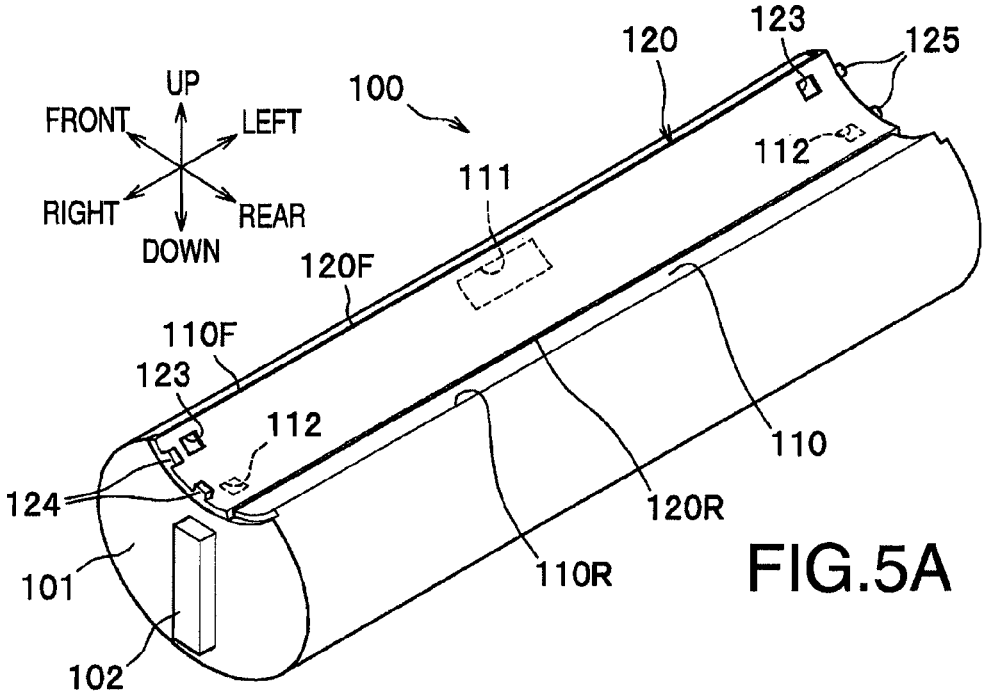
FIG. 5A is a perspective view of the toner box according to the embodiment of the present invention with a first shutter in a closed position.
Figure 5B:
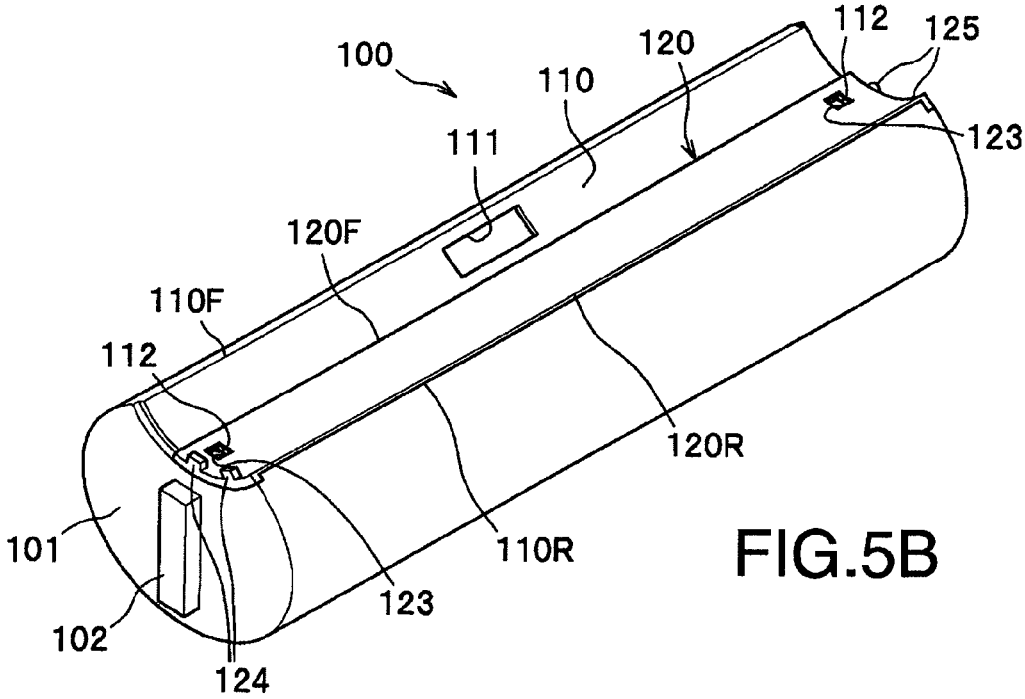
FIG. 5B is a perspective view of the toner box according to the embodiment of the present invention with the first shutter in an open position.

The first feeding hole 111 and the first collecting holes 112 are formed in laterally (in the right-left direction) displaced positions. The right-left direction in the present embodiment corresponds to the direction of the rotation axis 140 of the agitator 140. As shown in FIGS. 5A and 5B, the first feeding hole 111 is formed in the fitting wall 110 in a central area with respect to the right-left direction. Each first collecting hole 112 is formed in vicinity of either a left or a right side end of the fitting wall 110.

Further, as shown in the cross-sectional view shown in FIG. 4, the first feeding hole 111 is formed in a one-sided position closer to the front of the curvature of the fitting wall 110. Meanwhile, the first collecting holes 112 are formed to orient downward in a lowermost position in the curvature of the fitting wall 110.

The toner box 100 includes a first shutter 120 (see FIGS. 5A and 5B), which is slidable along the curvature of the fitting wall 110, to cover and expose the first feeding hole 111 and the first collecting holes 112. The first shutter 120 is formed in an arc to fit with the curvature of the fitting wall 110. A right and left side edges of the first shutter 120 is supported to be slidable along the curvature of the fitting wall 110.

In particular, the first shutter 120 is slidable between a front position (see FIG. 5A), which is closer to a front edge of the curvature of the fitting wall 110, and a rear position (see FIG. 5B), which is closer to a rear edge of the curvature of the fitting wall 110.

When the first shutter 120 is in the front position, a front edge 120F of the first shutter 120 stays on or inside a front edge 110F of the fitting wall 110. When the first shutter 120 is in the rear position, a rear edge 120R of the first shutter 120 stays on or inside a rear edge 110R of the fitting wall 110. In other words, the first shutter 120 is slidable within a range in the front-rear direction corresponding to the surface of the fitting wall 110 and does not protrude beyond the front edge 110F or the rear edge 120R.

The first shutter 120 is formed to have two openings 123. Each opening 123 is formed in an area closer to the front edge 120F and in the vicinity of the right and left side edges of the first shutter 120. When the first shutter 120 is in a closing position (i.e., the front position as shown in FIG. 5A), the first feeding hole 111 and the first collecting holes 112 are covered with the first shutter 120. When the first shutter 120 is shifted in an opening position (i.e., the rear position as shown in FIG. 5B), the first feeding hole 111 is uncovered, and the openings 123 coincide with the first collecting holes 112. Accordingly, the first collecting holes 112 and the first feeding hole 111 are exposed.

The first shutter 120 is formed to have teeth 124, which project toward a center (i.e., the reference line BL) of the curvature of the fitting wall 110, on the right side edge thereof. Further, the first shutter 120 is formed to have teeth 125, which project horizontally leftward, on the left side edge thereof. The teeth 124, 125 become in engagement with dents 224, 225 (see FIGS. 7A, 7B) respectively, which are formed in a second shutter of the developer device 200, when the toner box 100 is attached to the developer device 200. The second shutter 200 will be described later in detail.

Inside the toner box 100, an agitator 140 (see FIG. 4) to stir the toner in the toner box 100 is provided. The agitator 140 has a rotation shaft 141, a support 142, and a plurality of wings 143 (see also FIG. 6). The rotation shaft 141 is rotatably supported by the left and right side walls 101. The support 142 extends from the rotation shaft 141 radially, and the wings 143 being flexible sheets are fixed to the support 142.

The agitator 140 is rotated by driving force from a motor (not shown) transmitted to the rotation shaft 141. In the present embodiment, the agitator 140 is rotated in a clockwise direction as indicated by an arrow inside the toner box 100 in FIG. 4. As the agitator 140 rotates, free ends of the wings 143 sweep inner surfaces of the toner box 100, including an inner surface of the fitting wall 110, and the toner in the toner box 100 is stirred. In this regard, the toner is lifted to be carried by the wings 143 toward the first feeding hole 111.

Figure 6:
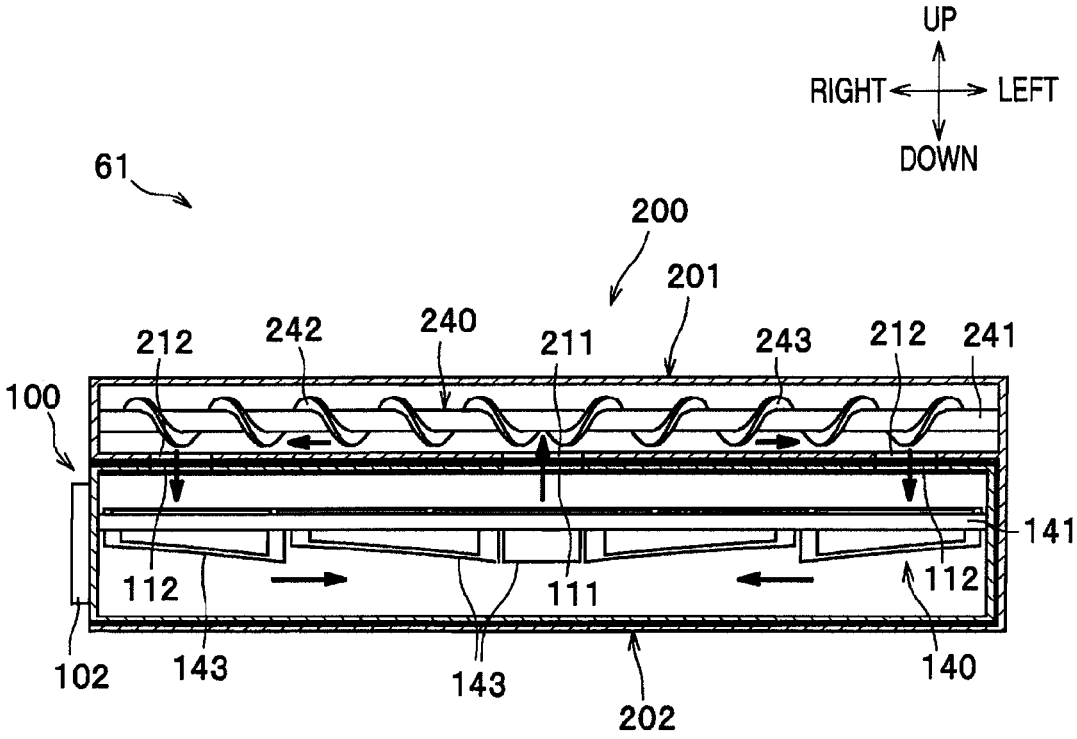
FIG. 6 illustrates a flow of the toner circulated in the developer unit according to the embodiment of the present invention.

A shape and a number of the wings 143 are arbitrarily decided in consideration of efficiency to move the toner in the toner box 100 from the right and left end areas, in which the first collecting holes 112 are formed, toward the central area, in which the first feeding hole 111 is formed (see also FIG. 6). A configuration of such an agitator is known; therefore detailed explanation of that is herein omitted.

According to the present embodiment, the first feeding hole 111 is formed in the fitting wall 110 in an upper-stream position with respect to a point (not shown) nearest to the rotation shaft 141 of the agitator 140 in the rotating direction of the agitator 140. Therefore, as the wings 143 rotate in the clockwise direction in FIG. 4, the wings 143 moving closer to the first feeding hole 111 uplifts the toner toward the first feeding hole 111. Thus, the toner is pushed out of the toner box 100 in the developer section 201 through the first feeding hole 111.

Next, the developer devices 200 will be described. Each of the developer devices 200 includes the developer section 201 and an attachment section 202, which is arranged in a lower position with respect to the developer section 201. The attachment section 202 is an open-ended tubular casing, in which the toner box 100 is detachably installed.

The developer section 201 includes the photosensitive drum 61A, the charger 61B, the developer roller 61C, the supplier roller 61D, the spreader blade 61E, and an auger 240.

The photosensitive drum 16A is formed to have a photosensitive layer on an outer surface of a conductive drum body. The charger 61B electrically charges the photosensitive drum layer of the photosensitive drum 61A evenly. The charger 61B is arranged in a lower rear position with respect to the photosensitive drum 61A with a predetermined amount of clearance from the photosensitive drum 61A.

The developer roller 61C carries the toner on a surface thereof and supplies the toner to an electrostatic latent image formed on the surface of the photosensitive drum 61A. The supplier roller 61D is arranged in a lower front position with respect to the developer roller 61C. The spreader blade 61E restricts thickness of the toner being carried on the surface of the developer roller 61C. The spreader blade 61E is arranged in a lower position with respect to the developer roller 61C to be in contact with the developer roller 61C.

The developer section 201 has a curved partition 210, which is formed to fit the curvature of the fitting wall 110 when the toner box 110 is attached to the developer device 200, in a lower section thereof. The curved partition 210 is further formed to have a second feeding hole 211 and second collecting holes 212. The second feeding hole 211 is formed in a position to coincide with the first feeding hole 111 of the toner box 100, and the second collecting holes 212 are formed in positions to respectively coincide with the first collecting holes 212 of the toner box 100, when the toner box 100 is attached to the developer device 200.

The tubular section of the attachment section 202 is open at one end (i.e., at the right-side end in the present embodiment) and closed at the other end (i.e., at the left-side end in the present embodiment). The left-side end of the attachment section 202 is closed by a left-side wall 202A. In the left-side wall 202A of the attachment section 202, a sector-formed opening 202B is formed (see FIGS. 7A, 7B). The opening 202B allows a part of the first shutter 120 to access a part of a second shutter 220 (see FIG. 4) so that the second shutter 220 is movable in cooperation with the first shutter 120. The configuration and the movement of the second shutter 220 in cooperation with the first shutter 120 will be described below in detail.

The second shutter 220 is movable along curvature of a lower surface of the curved partition 210 to cover and expose the second feeding hole 211 and the second collecting holes 212. The second shutter 220 includes a metal plate 221, which is formed to curve along the curved partition 210, and a pair of rotary discs 222 (see FIGS. 7A, 7B), which are fixed to right and left side edges of the metal plate 221.

The metal plate 221 is arranged in a position to vertically overlap the first shutter 120 when the toner box 100 is attached to the developer device 200. In the metal plate 221, two openings (not shown) are formed in positions to correspond to the openings 123 of the first shutter 120.

Figure 7A:
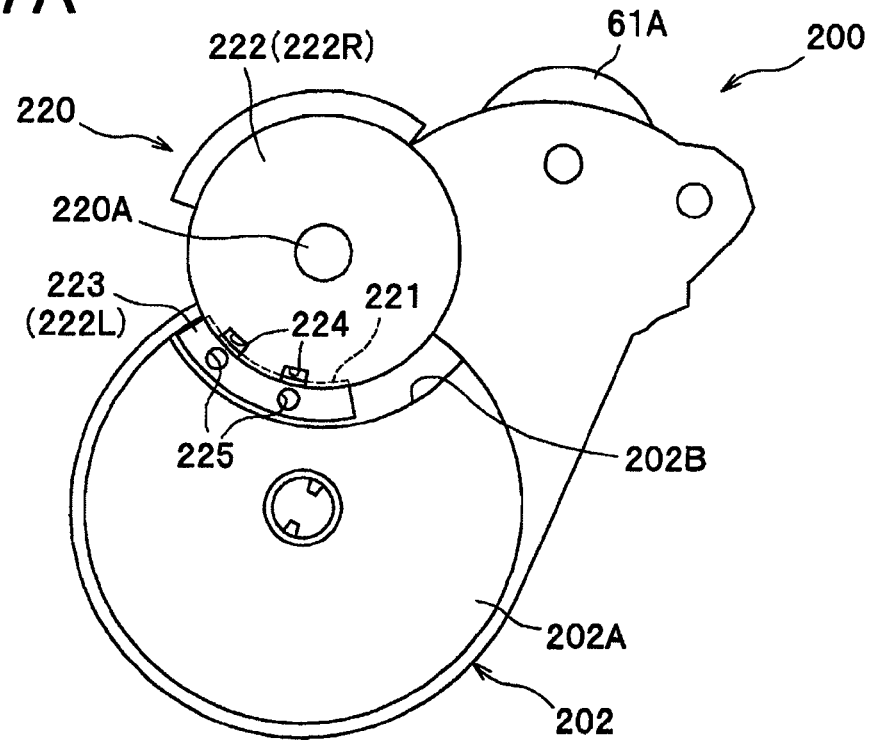
FIG. 7A is a cross-sectional side view of the developer device without the toner box and with a second shutter in a closed position.
Figure 7B:
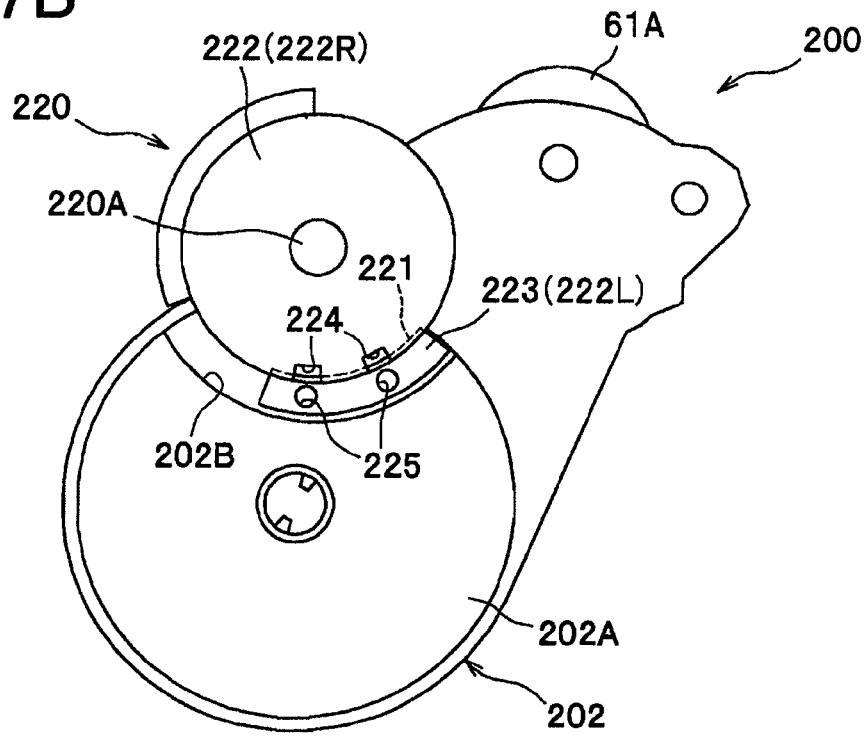
FIG. 7B is a cross-sectional side view of the developer device without the toner box and with the second shutter in an open position.
Figure 8:
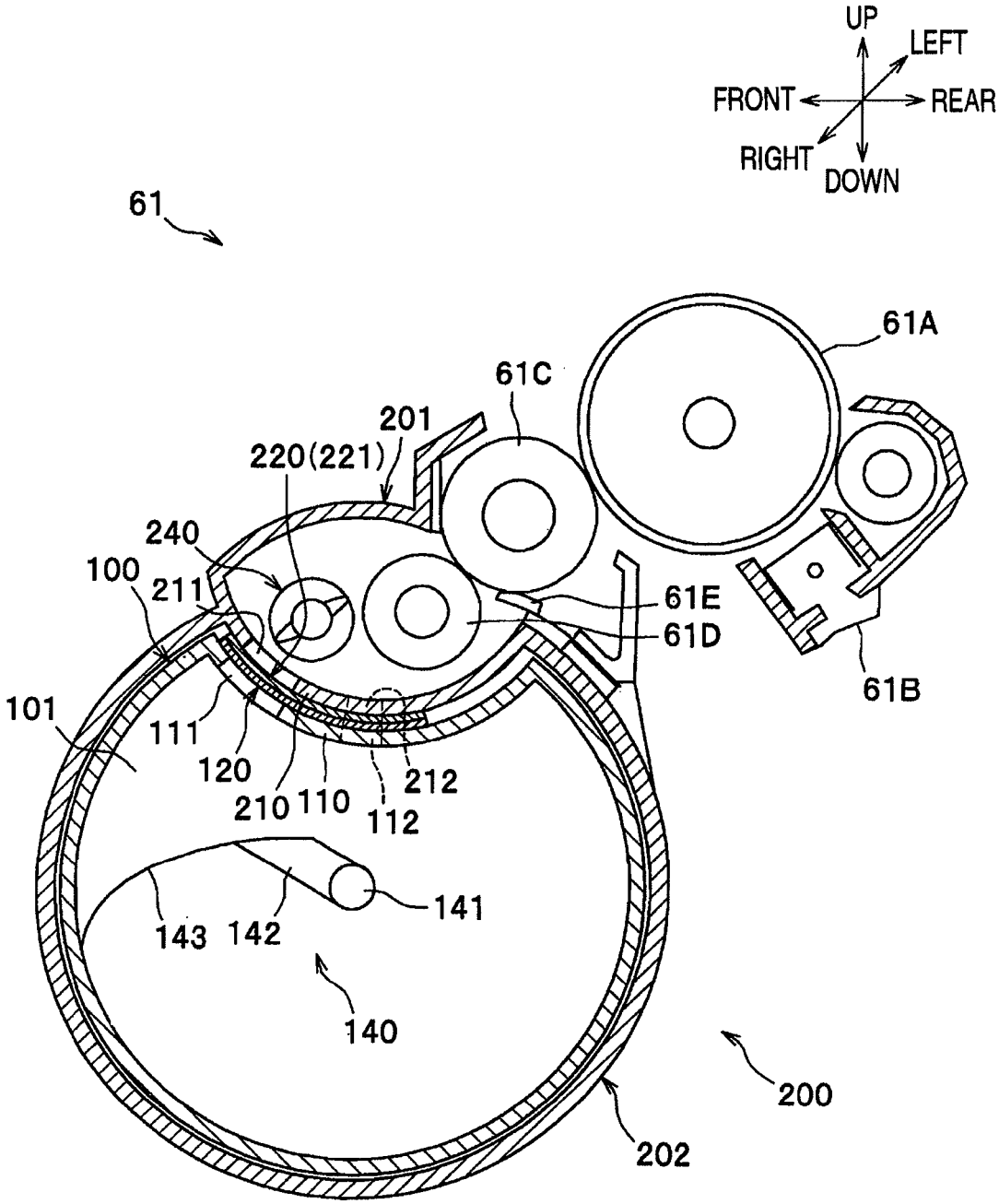
FIG. 8 is a cross-sectional side view of the developer unit according to the embodiment of the present invention with the shutters in the closed positions.

The rotary discs 222, including a right side rotary disc 222R and a left side rotary disc 222L, are arranged on the right and left ends of the developer section 201. In FIGS. 7A and 7B, solely the right side rotary disc 222R appears. The rotary discs 222 are rotatable about a rotation shaft 220A, which coincides with a reference line BL being an axis of the arc of the curved partition 210.

When the second shutter 220 is in a closing position (see FIG. 8), the second feeding hole 211 and the second collecting holes 212 are covered with the metal plate 221. When the second shutter 220 is moved rearward along the lower surface of the curved partition 210 to an opening position (see FIG. 4), the second feeding hole 211 is uncovered, and the unshown openings in the metal plate 221 coincide with the second collecting holes 212. In this regard, when the first shutter 120 is also in the opening position, the second collecting holes 212 become in communication with the first collecting holes 112 through the openings 123 in the first shutter 120 and the unshown openings in the metal plate 221, and the second feeding hole 211 becomes in communication with the first feeding hole 111.

One of the rotary discs 222, specifically the right side rotary disc 222R in the present embodiment, is formed to have dents 224 (see FIGS. 7A, 7B), which are dented to orient the rotation shaft 220A of the rotary disc 222R. The dents 224 are interlocked with the teeth 124 of the first shutter 120 when the toner box 100 is attached to the developer device 200. On the other hand, the left side rotary disc 222L is provided with a sector-shaped jut 223, which protrudes inward in the opening 202B and droops downward. The jut 223 is formed to have dents 225, which are dented horizontally to be interlocked with the teeth 125 of the first shutter 120 through the opening 202B when the tone box 100 is attached to the developer device 200. In other words, when the toner box 100 is attached to the developer device 200, the teeth 124, 125 of the first shutter 120 and the dents 224, 225 of the second shutter 220 are interlocked with each other respectively. Accordingly, the first shutter 120 and the second shutter 220 are movable in cooperation with each other between the opening position and the closing position.

For example, when the first shutter 120 and the second shutter 220 are in the closing position (see FIG. 8), the first shutter 120 can be moved rearward along the curvature of the fitting wall 110. In this regard, the teeth 124, 125 push the interlocking dents 224, 225 rearward. Accordingly, the second shutter 220 is moved rearward along the curvature of the curved partition 210. Thus, the first shutter 120 and the second shutter 220 are moved to the opening position (see FIG. 4). In this regard, the first feeding hole 111 of the toner box 100 becomes in communication with the second feeding hole 211 of the developer device 200, and the first collecting holes 112 become in communication with the second collecting holes 212. Thus, the toner box 100 and the developer section 201 become in communication with each other.

When the first shutter 120 and the second shutter 220 are in the opening position (see FIG. 4), the second shutter 200 can be moved frontward along the curvature of the curved partition 210. In this regard, the dents 224, 225 push the interlocking teeth 124, 125 frontward. Accordingly, the first shutter 120 is moved frontward along the curvature of the fitting wall 110. Thus, the first shutter 120 and the second shutter 220 are moved to the closing position (see FIG. 8).

In order for a user to manipulate the first shutter 120 and the second shutter 200 easily, at least one of the toner box 100 and the developer device 200 may be provided with a manipulating part, such as a knob or a handle, through which the at least one of the toner box 100 and the developer device 200 is moved in the front-rear direction.

The auger 240 is a roller with a shaft 241 and spirals 242, 243 to convey the toner fed through the first feeding hole 111 (and the second feeding hole 211) toward the first collecting holes 112 (and the second collecting holes 212) (see FIG. 6). The shaft 241 is rotatably supported by right and left side walls of the developer section 201, and the spirals 242, 243 twine around the shaft 241. The auger 240 has an axial length substantially equivalent to an axial length of the supplier roller 61D and is arranged in parallel with an axial direction of the supplier roller 61D.

The spirals 242, 243 are respectively arranged on a right side and a left side of the shaft 241, which are divided at a lengthwise center of the shaft 241. The spirals 242, 243 twine in different directions from each other. Accordingly, the toner in the right side area in the developer device 200 is conveyed leftward by the spiral 242, and the toner in the left side area is conveyed rightward by the spiral 243.

Effects of the Developer Unit

Next, circulation of the toner within the developer unit 61 and advantageous effects of the developer unit 61 according to the embodiment will be described. When the toner box 100 is attached to the developer device 200, and when the agitator 140 rotates, the toner in the toner box 100 is uplifted by the wings 143 of the agitator 140 and tossed to the developer device 200 through the first feeding hole 111 and the second feeding hole 211. A part of the toner supplied the developer device 200 is carried by the developer roller 61 and used in image forming. Another part of the toner remaining in the developer device 200 is carried rightward and leftward by the auger 240 to be retrieved through the second collecting holes 212 and the first collecting holes in the toner box 100 by use of gravity (see FIGS. 4, 6).

According to the above configuration of the developer unit 61 with the agitator 140 to carry the toner to the first feeding hole 111 (i.e., to the developer section 201) and the auger 240 to carry the toner within the developer section 201 toward the first collecting holes 112, the toner can be circulated smoothly in the developer unit 61, in which the toner box 100 is arranged in the lower position with respect to the developer device 200.

According to the above configuration of the developer unit 61, the first feeding hole 111 and the first collecting holes 112 are in positions laterally (in the right-left direction, which is parallel with the axial direction of the rotation axis 141 of the agitator 140) displaced from each other. The first feeding hole 111 and the first collecting holes 112 are not aligned in line which is parallel with the rotation axis 141 of the agitator 140. In other words, the first feeding hole 111 may be formed in a position, through which the toner is easily fed to the developer device 200, and the first collecting holes 112 may be formed in different positions, through which the toner is easily retrieved in the toner box 100. Therefore, fluidity of the toner between the toner box 100 and the developer device 200 and agitation efficiency of the toner are improved to be better than fluidity and agitation efficiency of toner in a toner box and a developer device with the first feeding hole 111 and the first collecting holes 112 being formed in laterally coinciding positions.

According to the above configuration, the first collecting holes 112 and the second collecting holes 212 are formed to orient downward; therefore, the remaining part of the toner in the developer section 201 can smoothly drop down in the toner box 100 to be retrieved by use of gravity.

Next, a flow of the toner to be supplied to the developer roller 61C in the developer section 201 will be described. The toner supplied to the developer section 201 is carried rightward and leftward by the rotating auger 240 toward the second collecting holes 212.

According to the present embodiment, the auger 240 is arranged in parallel with the axial direction of the supplier roller 61D; therefore, the toner is carried in the axial direction along the supplier roller 61D. Thus, the toner can be supplied evenly to an entire lengthwise-range of the supplier roller 61D and further to the developer roller 61C.

According to the developer unit 61 in the above embodiment, the first collecting holes 112 and the second collecting holes 212 are oriented downward to connect the developer section 201 with the toner box 100. Therefore, by use of gravity, the toner can drop down naturally in the toner box 100, and the toner box 100 can retrieve a substantial amount of toner from the developer device 200 efficiently without a specific mechanism to forcibly drop the toner. In other words, one first collecting hole 112 at each side of the fitting wall 110 and one second collecting hole 212 at each side of the curved partition 210 are substantial to retrieve the toner in the toner box 100. Meanwhile, without the forcible dropper mechanism, a substantial amount of the toner can be kept in the developer section 201 to be used for image-forming. Therefore, a substantial amount of toner to be carried by the auger 240 and supplied to the supplier roller 61D can be secured, and the developer roller 61C can be supplied with the substantial amount of toner to form an image.

Thus, according to the above embodiment, in the developer unit 61, in which the toner box 100 is arranged in the lower position with respect to the developer device 200, the toner is circulated smoothly between the toner box 100 and the developer device 200, and the toner is supplied to the developer roller 61C efficiently.

According to the above developer unit 61, the toner box 100 is detachable from the developer device 200. Therefore, when the toner is used and runs out and the toner box 100 no more contains the toner, solely the toner box 100 can be exchanged with a new toner box 100. In other words, replacement of the entire developer unit including the developer section 201 is not necessary. Accordingly, running cost to maintain the MFP 1 can be effectively reduced.

In the above embodiment, the first shutter 120 is slidable along the curvature of the fitting wall 110, which has a cross-section of an arc. The arc-formed shutter 120 can be slid more stably and smoothly in parallel with the curvature compared to a plane-slide movement of a flat-plane shutter, which may slip on a flat surface. In other words, smooth and stable movement of the first shutter 120 can be maintained.

In the above embodiment, the first shutter 120 is movable between the opening position and the closing position within the front-rear range of the curvature of the fitting wall 110. If the first shutter 120 is movable beyond the range corresponding to the surface of the fitting wall 110, a room to accept the protruding portion of the first shutter 120 is required in the attachment section 202 of the developer device 200. However, according to the above embodiment, such a room is not necessary. Thus, rigidity of the developer device 200 can be maintained, and the configuration of the developer device 200 can be simplified. Further, when the room for the protrusive first shutter 120 is omitted, a volume of the developer device 200 can be downsized.

In the above embodiment, the first collecting holes 112 and the second collecting holes 212 are oriented downward to connect the developer section 201 with the toner box 100; therefore, a substantial amount of toner can naturally drop down in the toner box 100. In this configuration, sizes of the first and second collecting holes 112, 212 can be reduced. When the first and second collecting holes 112, 212 are smaller, sealers (not shown), which are provided on rims of the first and second collecting holes 112, 212 in order to prevent toner leakage, can be downsized. Accordingly, pressure from the sealers to the first and second shutters 120, 220 can be reduced. Therefore, the first and second shutter 120, 220 can be manipulated smoothly.

Although an example of carrying out the invention has been described, those skilled in the art will appreciate that there are numerous variations and permutations of the developer unit that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, the first feeding hole 111 and the first collecting holes 112 may not necessarily be formed in laterally (in the right-left direction, which is the axial direction of the rotation axis 141 of the agitator 140), but may be formed in same positions in the right-left direction.

For another example, the first collecting holes 112 and the second collecting holes 212 may not necessarily be formed to orient downward, but may be formed to orient obliquely downward or horizontally.

For another example, the fitting wall 100 may not necessarily be formed to have a cross-sectional shape of an arc as long as the fitting wall 100 is formed to curve inward. Further, a number, sizes, and shapes of the first feeding holes 111 and the first collecting holes 112 are not limited to those described in the above embodiment.

In the above embodiment, the developer section 201 is provided with a single supplier roller 61D; however, the developer section 201 may have a plurality of supplier rollers 61D. When a plurality of supplier rollers 61D are provided, the auger 240 may be arranged along solely one of the plurality of supplier rollers 61D or along two or more of the supplier rollers 61D. Further, the developer section 201 may be provided with a plurality of augers 240.

In the above embodiment, the developer units 61 detachable from the holder case 62 are described. However, for example, the developer unit 200 out of the developer unit 61 may be fixed to the holder case 62, and the developer device 200 and the holder case 62 may constitute a unit.

In the above embodiment, the developer unit 61 with the toner box 100 detachable from the developer device 200 is described. However, a developer unit 61 having a toner container undetachably fixed to the developer device may be provided.

Further, in the above embodiment, the developer section 201 detachable from the attachment section 202 is described. However, the developer section 201 may be integrally formed with and undetachable from the attachment section 202. In other words, a single frame structure having the developer section 201 and the attachment section 202 may be provided. In such a structure, a single wall/partition can be formed between the developer section 201 and the attachment section 202 instead of the fitting wall 110 and the curved partition 210.

Further, the auger 240 to carry the toner sideward may be replaced with, for example, a coil spring.

Furthermore, the sheet P to have an image formed thereon may be, for example, an OHP sheet.

In the above embodiment, the MFP 1 being an image forming apparatus having the developer unit according to the present invention is described. However, the image forming apparatus may be, for example, a copier and a printer. Furthermore, the number of the developer unit 61 is not limited to four, but may be, for example, one.

What is claimed is:

1. A developer unit for an image forming apparatus to form an image on a recording sheet, comprising:

a developer device comprising:

a developer agent carrier, which is configured to carry a developer agent on a surface thereof, and a developer agent supplier, which is configured to supply the developer agent to the developer agent carrier; and a developer agent container, which is configured to contain the developer agent to be supplied to the developer device and is arranged in a lower position with respect to the developer device, wherein the developer agent container comprises a fitting wall, which is curved inward at a position adjacent to the developer device;

wherein the fitting wall has:

a feeding opening, through which the developer agent in the developer agent container is supplied to the developer device, and a collecting opening, through which at least a portion of the developer agent in the developer device is retrieved back to the developer agent container; and wherein the developer unit further comprises:

a first conveyer, which is configured to rotate about a rotation axis to sweep an inner surface of the developer agent container and to convey the developer agent toward the feeding opening; and a second conveyer, which is disposed above the first conveyor, arranged along the developer agent supplier, and configured to convey the developer agent toward the collecting opening.

2. The developer unit according to claim 1, wherein the feeding opening and the collecting opening are formed in positions displaced from each other with respect to a direction of the rotation axis of the first conveyer.

3. The developer unit according to claim 1, wherein the collecting opening is formed to orient downward toward the developer agent container to connect the developer device and the developer agent container.

4. The developer unit according to claim 1, wherein the developer agent container is detachably attached to the developer device.

5. The developer unit according to claim 4, wherein the fitting wall is curved inward in an arc in cross-section to center around a reference line, which extends in parallel with a rotation axis of the first conveyer; and wherein the developer agent container comprises a shutter, which is configured to move along the curvature of the fitting wall to cover and expose the feeding opening and the collecting opening.

6. The developer unit according to claim 5, wherein the feeding opening is formed in one side in the curvature of the fitting wall; and wherein the shutter is configured to move within a range between the one side and the other side opposite from the one side in the curvature of the fitting wall along the curvature.

* * * * *